US009038211B2

(12) United States Patent
Hedaya

(10) Patent No.: US 9,038,211 B2
(45) Date of Patent: May 26, 2015

(54) SHOWER CURTAIN INCORPORATING ENTERTAINMENT SYSTEM

(75) Inventor: Joseph A. Hedaya, New York, NY (US)

(73) Assignee: HEDAYA HOME FASHIONS, INC., Elizabeth, NJ (US)

( * ) Notice: Subject to any disclaimer, the term of this patent is extended or adjusted under 35 U.S.C. 154(b) by 373 days.

(21) Appl. No.: 13/557,652

(22) Filed: Jul. 25, 2012

(65) Prior Publication Data

US 2014/0026316 A1 Jan. 30, 2014

(51) Int. Cl.

| | |
|---|---|
| ***A47K 3/34*** | (2006.01) |
| ***A47K 3/28*** | (2006.01) |
| ***A47K 3/38*** | (2006.01) |

(52) U.S. Cl.

CPC .. *A47K 3/281* (2013.01); *A47K 3/38* (2013.01)

(58) Field of Classification Search

USPC ..... 4/557, 558, 607, 608, 661

See application file for complete search history.

(56) References Cited

U.S. PATENT DOCUMENTS

| | | | | |
|---|---|---|---|---|
| 4,880,145 | A | 11/1989 | McManus | |
| 4,964,181 | A | 10/1990 | Alpert | |
| 5,073,996 | A | 12/1991 | Schinle | |
| 5,140,254 | A | 8/1992 | Katzman | |
| 5,201,002 | A | 4/1993 | Dahlem | |
| 5,329,650 | A | 7/1994 | Zaccai et al. | |
| 5,499,767 | A | 3/1996 | Morand | |
| 5,761,751 | A | 6/1998 | Morrissey | |
| 6,021,208 | A | 2/2000 | Kin-Lung | |
| 6,044,161 | A | 3/2000 | Lee | |
| 6,163,899 | A * | 12/2000 | Leonard | 4/558 |
| 6,236,621 | B1 | 5/2001 | Schettino | |
| D466,886 | S | 12/2002 | Crane et al. | |
| 6,879,818 | B2 | 4/2005 | Wageneck | |
| 6,896,155 | B1 * | 5/2005 | Jones et al. | 222/106 |
| 7,350,244 | B1 | 4/2008 | Handley | |
| 7,445,549 | B1 | 11/2008 | Best | |
| D686,024 | S * | 7/2013 | Vagliardo | D6/580 |

FOREIGN PATENT DOCUMENTS

| | | |
|---|---|---|
| JP | 02277413 | 11/1990 |
| JP | 05056837 | 3/1993 |
| JP | 20025125825 | 5/2002 |

* cited by examiner

*Primary Examiner* — Tuan N Nguyen
(74) *Attorney, Agent, or Firm* — Gordon & Jacobson, PC

(57) ABSTRACT

A shower curtain is provided with two pockets adapted to receive spaced apart stereo speakers and a third pocket adapted to receive a personal entertainment system. The third pocket is provided with a clear inside window pane facing the inside of the shower and adapted for finger-touch control through the window pane. A closure system integral with the shower curtain is provided for external access to the pockets. In one embodiment, the closure system for access to the pockets is a tongue-in-groove fastening arrangement that provides external access to a personal entertainment system as well as a channel through which wires run to couple the entertainment system to the speakers.

19 Claims, 5 Drawing Sheets

SHOWER CURTAIN INCORPORATING ENTERTAINMENT SYSTEM

BACKGROUND

1. Field

This case relates broadly to a shower accessory. More particularly, this case relates to a shower curtain incorporating an entertainment system that may be operated from inside a shower while being protected from water damage.

2. State of the Art

It is supposed that the idea of music in the shower is almost as old as the idea of a warm shower itself. It is well known that it is common for people to sing in the shower. In modern showers, the combined effects of ceramic tile and water have an interesting, pleasant affect on musical sound waves.

In recent years, it has been possible to obtain a waterproof musical appliance such as a radio, tape player, or even a CD player. These devices are not only waterproof but they are also battery powered, thereby eliminating the possibility of electrical shock from power cords running through water. Typical among these devices is the "shower head radio" described in U.S. Pat. No. 6,879,818. See also the devices described in the patents cited in U.S. Pat. No. 6,879,818.

Most of the shower audio devices are located beneath the shower head and if they even are stereo, the speakers are so close to each other that the stereo effect is lost.

One of the most significant innovations in audio technology was the personal stereo, in particular the Sony Walkman which appeared in the late 1970s and was promptly copied by almost every audio manufacturer throughout the world. More recently, digital technology has replaced the traditional personal stereo with the MP3 Player. The extremely successful Apple iPod is ubiquitous in most major cities of the world and has radically changed the way people acquire and listen to audio. Through the use of many popular accessories, the iPod has become not only a personal stereo, but a car stereo and a home or office stereo.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

An apparatus is provided for adapting a personal entertainment system for use in a shower.

In one embodiment a shower curtain is provided with spaced apart stereo speakers and a pocket adapted to receive a personal entertainment system such as iPod (trademark of Apple), and iPhone or ITouch (trademarks of Apple), an iPAD (trademark of Apple), or the like.

According to one aspect, a shower curtain is provided with a pocket having a clear inside window (facing the inside of the shower) for holding the personal entertainment system. The clear inside window is preferably adapted for finger-touch control through the window. A closure system is provided for external access to the pocket.

In one embodiment, the pocket is sized to fit an iPAD or similar device, and the pocket is provided with an internal sub-pocket sized to fit an iPod or similar device.

In one embodiment, the closure system for access to the pocket is a zip-lock (i.e., plastic tongue-in-groove) fastening arrangement.

In one embodiment, a zip-lock fastening arrangement not only provides external access to a personal entertainment system located on a shower curtain but provides a channel through which wires are run to speakers.

According to one aspect, when the shower curtain is extended so as to close a tub area, the speakers are spaced sufficiently apart to achieve a true stereo effect.

Additional objects and advantages will become apparent to those skilled in the art upon reference to the detailed description taken in conjunction with the provided figures.

DETAILED DESCRIPTION

Figure 1:
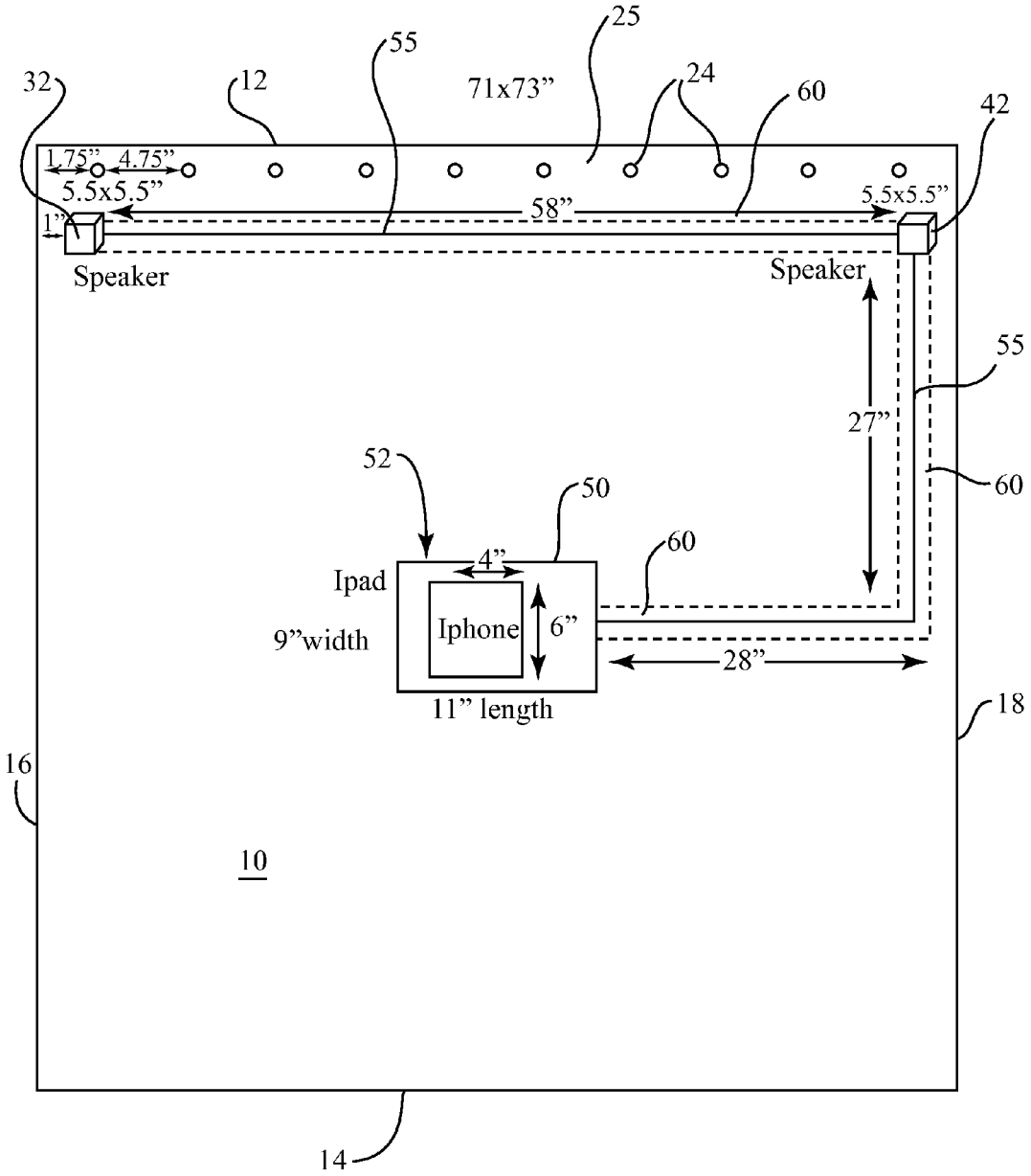
FIG. 1 is a schematic view of a shower curtain incorporating an entertainment system.
Figure 2:
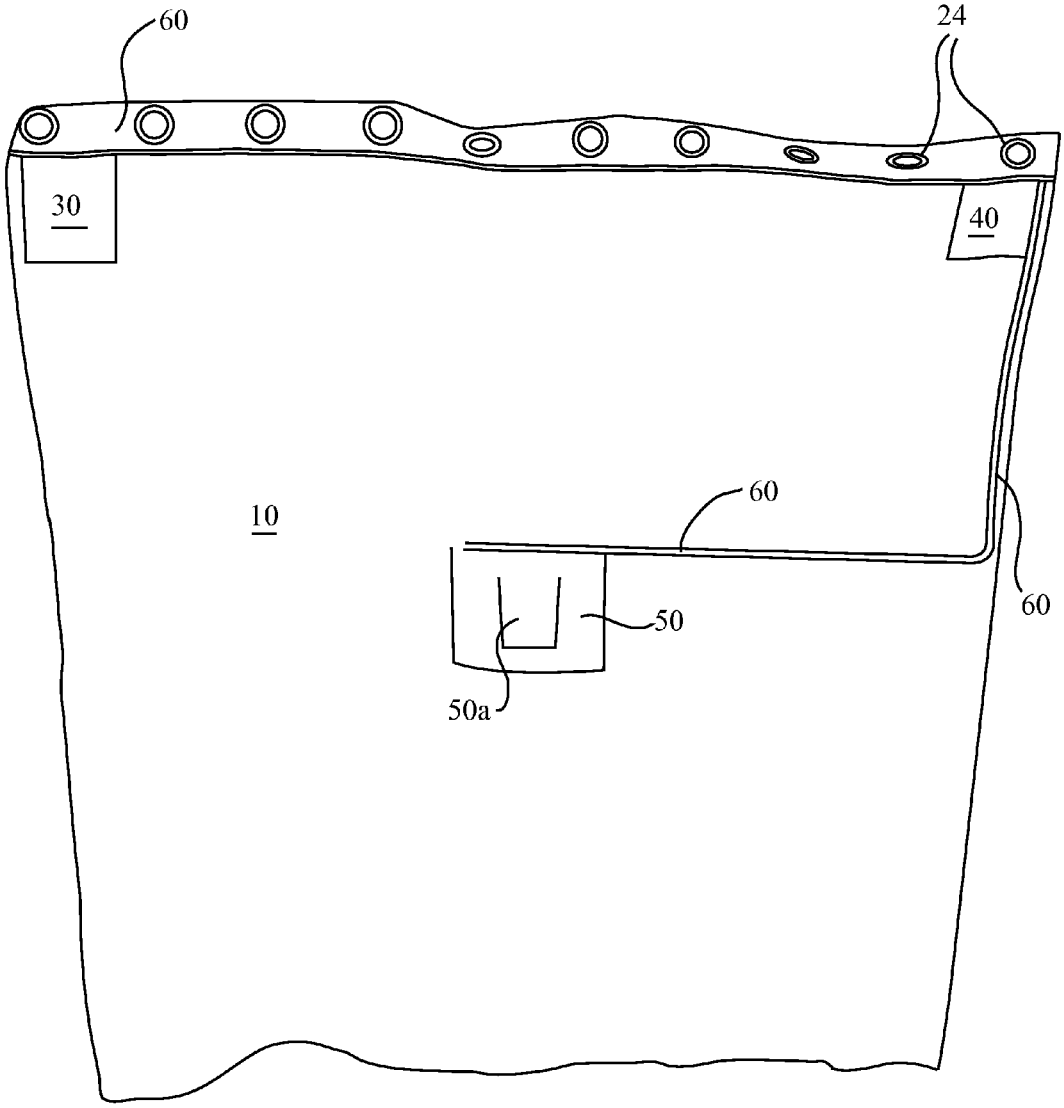
FIG. 2 shows a shower curtain with the pockets and the pocket-access fastening system for the entertainment system and its wiring highlighted.

Turning now to the Figures generally, a shower curtain 10 according to the invention has an upper edge 12, a lower edge 14, two side edges 16 and 18, inside surface 20, and an outside surface 22. The outside and/or inside surfaces are optionally provided with designs and graphics (not shown). The edges are generally straight, although they need not be. A plurality of eyelets 24 are arranged just below (i.e., adjacent) the upper edge 12 in an optionally reinforced area 25 of the shower curtain. These eyelets 24 are designed to either directly receive a curtain rod, or to receive means (e.g., hooks or loops) which couple the curtain 10 to curtain rod.

The curtain 10 as shown is provided with three pockets or compartments 30, 40, 50. Pocket 30 is adapted to contain a first speaker 32 while pocket 40 is adapted to contain a second speaker 42 and a battery pack (not shown). Pocket 50 is adapted to contain personal entertainment system 52 such as iPod, IPhone or ITouch (trademarks of Apple), an iPAD (trademark of Apple), or the like. System 52 is coupled to speakers 32 and 42 via one or more wires 55.

In one embodiment, pockets 30, 40, 50 are formed by sewing or welding plastic panels to the inside or outside of the curtain 10 (as discussed in more detail with reference to pocket 50). In one embodiment, the pockets may be closed by a closure system 60 which extends from the top of compartment 30, along the reinforced area 25 near the top of curtain 10 to the top of compartment 40, then down the side of the curtain near edge 18, and then inward toward the middle of the curtain 10 and over pocket 50. Closure system 60 is adapted to provide a protected channel 62 in which wires 55 run.

Figure 3A:
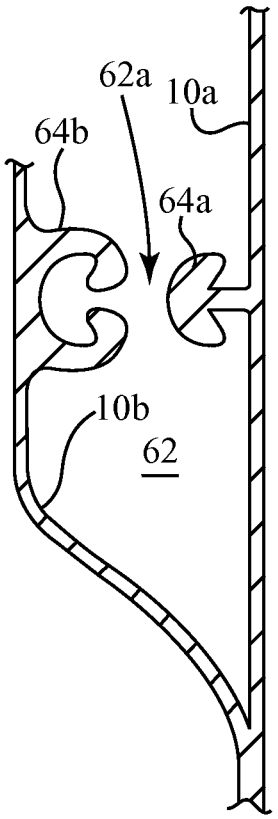
FIG. 3A is a broken cross-section showing one fastening arrangement on a shower curtain.

One embodiment of a closure system 60 is seen in FIG. 3A. In FIG. 3A, the closure system 60 is seen to include a first wall 10*a* which is part of the main panel of curtain 10, and a second wall 10*b* (flap or panel) which is integral with (e.g., by sewing, welding/heat-sealing, or otherwise) but extends away from wall 10*a*. A first closure mechanism (rib or tongue) 64*a* is formed along wall 10*a*, and a second closure mechanism (double rib or groove) 64*b* is formed along wall 10*b* facing the first closure mechanism. The closure mechanisms may be said to form a "zip-lock". In one position (not shown), the closure mechanisms 64*a* and 64*b* are adapted to mate with each other securely and form a closed channel 62. In another position, the closure mechanisms can be uncoupled from each other (as seen in FIG. 3A), thereby providing an opening 62*a* to channel 62. When in the opened position, wires 55 may be inserted into the channel.

It will be appreciated that at locations away from pockets 30, 40, 50, channel 62 is a small channel, as wall 10*b* is short. On the other hand depending upon the construction of the pockets, 30, 40 50, wall 10*b* can be long.

In one embodiment, pockets 30 and 40 are formed by providing a long wall 10*b* with closure mechanism 64*b*. With a long wall 10*b*, channel 62 effectively becomes a pocket along the horizontal width and the vertical length of wall 10*b*.

Figure 3B:
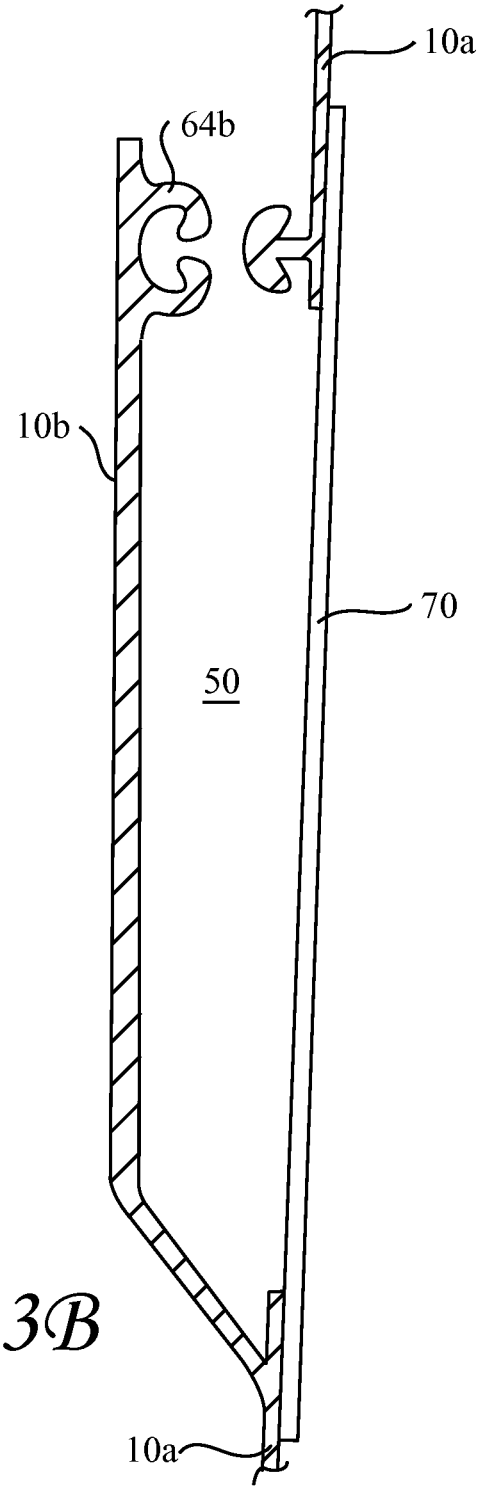
FIG. 3B is a broken cross-section showing the pocket on a shower curtain that receives an entertainment system.

Turning to FIG. 3B, pocket 50 is formed by providing a long wall 10*b* with closure mechanism 64*b*. However, unlike the arrangement shown in FIG. 3, wall 10*a* is cut away below closure mechanism 64*a* until the bottom of the pocket 50. In addition, a clear waterproof inside window pane or wall 70 (facing the inside of the shower) is attached on four sides (top, bottom and both sides) to wall 10*a*, so that together with wall 10*b*, window pane 70 forms a pocket for the entertainment system 52. The clear inside window pane 70 is preferably adapted for finger-touch control of entertainment system 52 therethrough.

Figure 4:
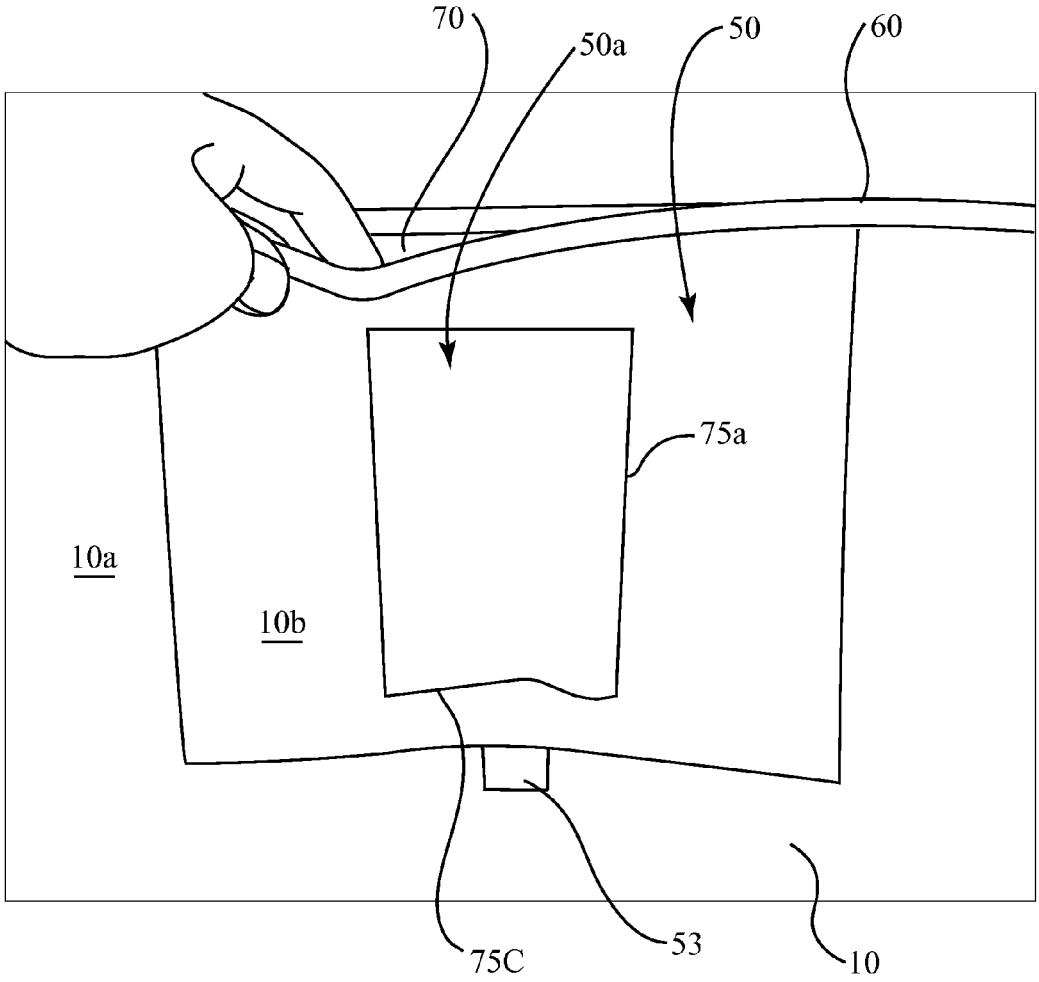
FIG. 4 is a diagram of a user's hand opening a fastener to a pocket of a shower curtain.

In one embodiment, pocket 50 may include a sub-pocket 50*a* (as seen in FIG. 4). Sub-pocket 50*a* may be formed by providing vertical walls 75*a*, 75*b* and a flap that is parallel to wall 10*b* and window pane 70. The vertical walls 75*a*, 75*b* may extend either off of wall 10*b* or window pane 70, and the flap (not shown) is attached to the vertical walls 75. A bottom wall 75*c* may also be provided. The top of sub-pocket 50*a* is open. In this manner pocket 50 may be sized (e.g., 9 inches by 11 inches) to closely receive an iPAD or similar device, while sub-pocket 50*a* may be sized (e.g., 4 inches by 6 inches) to closely receive an iPOD, IPhone, ITouch, or similar device. Of course, other size pockets may be utilized.

As seen in FIG. 4, a user's hand 80 may be used to open pocket 50 by separating wall 10*b* from wall 10*a* (i.e., opening closure mechanism 64*b*, 64*a*).

From the foregoing, it will be appreciated that speakers 32, 42 placed in the pockets 30, 40 of the shower curtain 10 can be connected to the personal entertainment system 52 in pocket 50 (or 50*a*) by running wires in channel 62 from entertainment system 52 to speaker 42 and from speaker 42 to speaker 32. Alternatively, entertainment system 52 can have one wire connected to speaker 42 and another wire directly connected to speaker 32. In addition, a battery pack (not shown) may be placed, if desired, in pocket 30 or 40. Activation of entertainment system 52 can cause audio to be produced inside the shower by the speakers. At the same time, because of the construction of the shower curtain, the speakers 32, 42, and the entertainment system 52 are protected from shower water.

In one embodiment, a power switch (not shown) is provided adjacent a jack (not shown) connected to wires 55, with the jack is adapted to connect to the entertainment system 52. The power switch is adapted to fit in pocket 50 with the entertainment system.

In one embodiment, a tab 53 is provided adjacent pocket 50. The tab 53 (FIG. 4) may be held by a user to prevent the curtain 10 from pushing outward when manipulating the entertainment system 52. The tab 53 may be located just below pocket 50, or to one side of pocket 50, or even on the clear exterior wall of the pocket 50.

In one embodiment the shower curtain is approximately 71 inches (wide) by 73 inches (long) and pocket 50 is substantially centrally located on the curtain 10. The shower curtain is optionally made of waterproof or water resistant material (e.g., a polyester, nylon, or other fabric), or other material treated with an agent to make it waterproof or water resistant. The speakers are optionally of a water-resistant or waterproof design, and are also optionally slim (e.g., one inch thick or less) and relatively small (e.g., 5.5 inch square or smaller), although thicker and larger speakers and amplifier may be utilized if desired. As will be appreciated, the pockets accommodating the speakers may be of any desired size.

Figure 5:
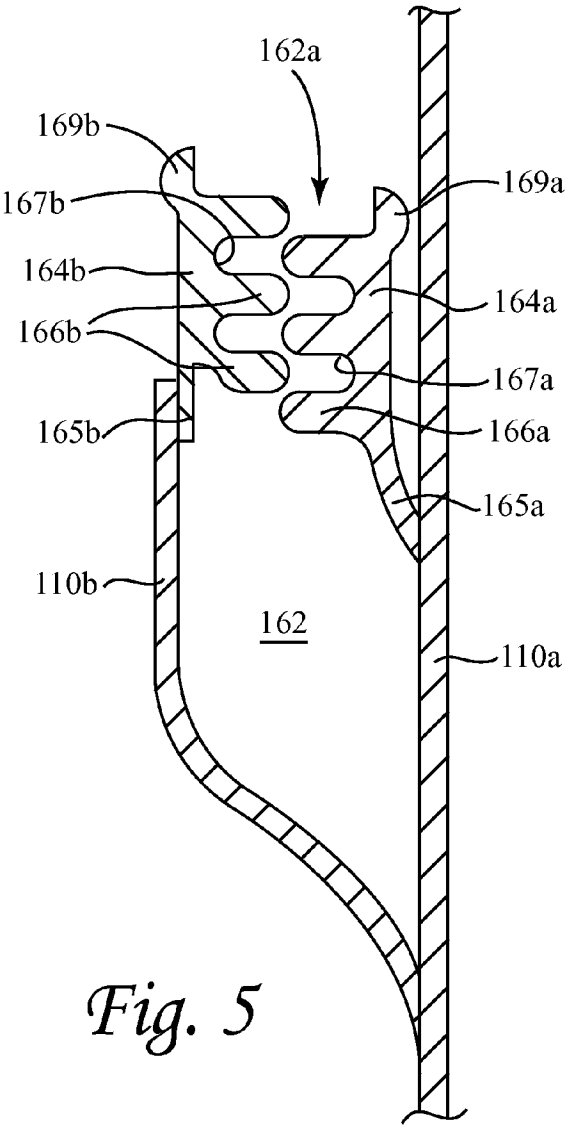
FIG. 5 is a broken cross-section showing another fastening arrangement at a pocket of a shower curtain.

Turning to FIG. 5, another embodiment of a fastening arrangement or closure system at a pocket location is shown. In FIG. 5, the closure system 160 is seen to include a first wall 110*a* which is part of the main panel of curtain, and a second wall 110*b* (flap or panel) which is integral with (e.g., by sewing, welding/heat-sealing, or otherwise) but extends away from wall 110*a*. A first closure mechanism 164*a* is formed along wall 110*a*, and a second closure mechanism 164*b* is formed along wall 110*b* facing the first closure mechanism. First closure mechanism 164*a* is shown to include an arm section 165*a* which is welded or stitched to wall 110*a*, a series of protrusions 166*a* defining one or more valleys 167*a*, and a track portion 169*a*. Second closure mechanism 164*b* likewise includes an arm section 165*b* which is welded or stitched or otherwise attached to wall 110*b*, a series of protrusions 166*b* defining one or more valleys 167*b*, and a track portion 169*b*. The closure mechanisms may be said to form a "zip-lock", and a zip-lock zipper may be used to ride on the track portions 169*a*, 169*b* and over the closure mechanisms 164*a*, 164*b* to force one or more protrusions 166*a* into one or more valleys 167*b*, and one or more protrusions 166*b* into one or more valleys 167*a*. In one position (not shown), the closure mechanisms 164*a* and 164*b* are adapted to mate with each other securely and form a closed channel 162. In another position, the closure mechanisms can be uncoupled from each other thereby providing an opening 162*a* to channel 162*a*. When in the opened position, one or more wires may be inserted into the channel.

Figure 6:
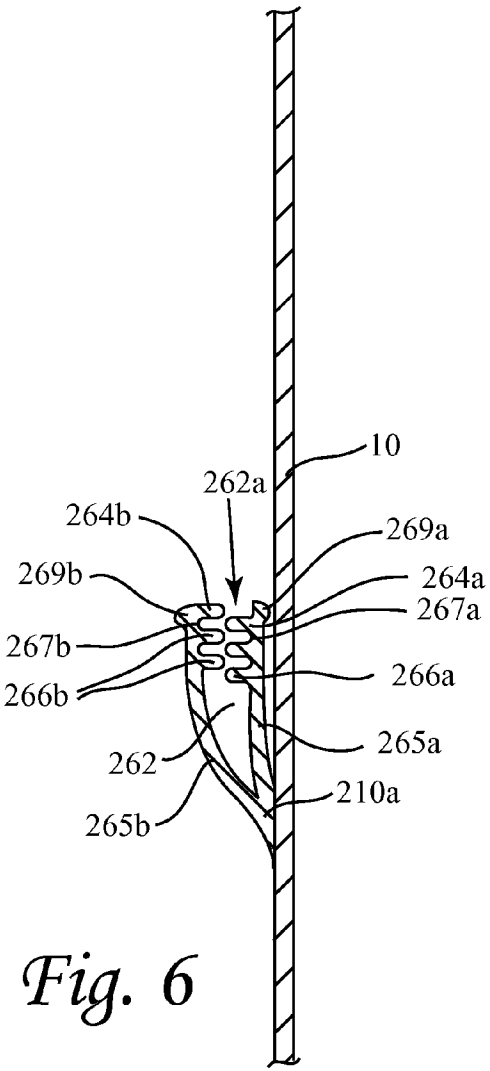
FIG. 6 is a broken cross-section showing another embodiment of a channel for a shower curtain.

One embodiment of a channel fastening arrangement for a shower curtain is seen in FIG. 6. In particular, curtain 210 is seen with a fastener 261 having a first and second closure mechanisms 264*a*, 264*b*. The fastener includes a base 210*a* that is fastened by welding, stitching or otherwise to the curtain 210, and from which the first and second closure mechanisms extend. First closure mechanism 264*a* is shown to include an arm section 265*a* extending from base 210*a*, a series of protrusions 266*a* defining one or more valleys 267*a*, and a track portion 269*a*. Second closure mechanism 264*b* likewise includes an arm section 265*b* extending from the base 210*a*, a series of protrusions 266*b* defining one or more valleys 267*b*, and a track portion 269*b*. The closure mechanisms may be said to form a "zip-lock", and a zip-lock zipper may be used to ride on the track portions 269*a*, 69*b* and over the closure mechanisms 264*a*, 264*b* to force one or more protrusions 266*a* into one or more valleys 267*b*, and one or more protrusions 266*b* into one or more valleys 267*a*. In one position (not shown), the closure mechanisms 264*a* and 264*b* are adapted to mate with each other securely and form a closed channel 262. In another position, the closure mechanisms can be uncoupled from each other thereby providing an opening 262*a* to channel 262*a*. When in the opened position, one or more wires may be inserted into the channel.

The curtain is generally used as follows. In one embodiment, either prior to hanging the curtain on a rod, or after the curtain is hung on a curtain rod, (e.g., a shower rod), pockets 50 and 40 are opened, if not already opened, and channel 62 (162) (262) is opened if not already open. An entertainment system 52 is placed into pocket 50 (or pocket 50*a*) and a speaker is placed into pocket 40, and a wire 55 (with appropriate jacks, if required) connecting the two is placed into the channel 62 (162) (262) via channel opening 62*a* (162*a*) (262*a*). The closure mechanism 64*a*, 64*b* (164*a*, 164*b*) (264*a*, 264*b*) is closed (e.g., "zipped") to seal the wire 55 in the channel 62 (162) (262), and closure mechanism at the top of pockets 40 and 50 is also preferably closed.

In another embodiment, one or more speakers are provided in pockets 40, 30 and wires 55 (typically terminating in jacks) are provided in channel 62 in conjunction with the curtain 10 at the point of sale. If desired, a battery pack (not shown) for powering the speakers may also be provided at the point of sale. Thus, after purchase, the purchaser/user of the curtain need only hang the curtain on a rod, open pocket 50 (or pocket 50*a*), place the entertainment system 52 into the pocket 50 (or 50*a*), and connect the wire (jack) into the entertainment system 52. If a power switch is provided, the power switch can be turned on.

Once in place, the entertainment system 52 is used by touching appropriate keys or screen locations (not shown) of the entertainment system 52 through the window pane 70.

In one embodiment, if not already provided at point of sale, a second speaker may be placed into pocket 30, and a wire connecting speaker 42 to speaker 32 or connecting entertainment system 52 to speaker 32 is run through the channel 62 (162) (262). The closure mechanism 64*a*, 64*b* (164*a*, 164*b*) (264*a*, 264*b*) is closed.

In one embodiment, if not already provided at point of sale, batteries for powering the speaker(s) 42, 32 may be placed in one of pockets 40, 30 and electrically coupled to the speakers.

There have been described and illustrated herein embodiments of a shower curtain for use with an amplifier and speakers, as well as related methods. While particular embodiments have been described, it is not intended to be limited thereto, as it is intended that the invention be as broad in scope as the art will allow and that the specification be read likewise. Thus, while a shower curtain has been disclosed, it will be appreciated that the concept of mounting speakers and an entertainment system inside some other type of curtain is within the breadth of this disclosure. Further, while a shower curtain of a certain size has been disclosed it will be appreciated that the shower curtain could be smaller or longer in length or height, although it will typically have at least dimension of at least 60 inches. Likewise, the pockets can be of different sizes. Also, while a particular closure system has been disclosed, it will be appreciated that other closure systems could be utilized. By way of example only, and not by way of limitation, it will be appreciated that two separated tongue-and-groove mating element groupings could be provided and the channel for the wires could be between the two groupings. Also, by way of example only, and not by way of limitation, a zipper could be provided as mating element. It will therefore be appreciated by those skilled in the art that yet other modifications could be made without deviating from the spirit and scope of the claims.

What is claimed is:

1. A curtain system for use with an entertainment system having at least one wire, said curtain system comprising:

a curtain including (i) a sheet of generally rectangular material having an upper edge, a lower edge, and two side edges, (ii) a first wall integral with and extending away from said sheet and defining a first pocket in conjunction with said sheet, (iii) a clear waterproof second wall sealed to said sheet and forming a wall of a second pocket adapted to receive the entertainment system therein, said clear wall adapted to permit finger-touch control of the entertainment system through said clear second wall, and (iv) a closure system including a third wall integral with said sheet, said closure system providing a channel between said first wall and said third wall where said channel couples said first pocket with said second pocket, said channel adapted to receive the at least one wire; and a first speaker located inside said first pocket.

2. A curtain system according to claim 1, wherein:

said closure system closes a top of said first pocket and closes a top of said second pocket.

3. A curtain system according to claim 1, wherein:

said closure system comprises a tongue and a groove, with one of said tongue and groove extending from said sheet, and the other of said tongue and groove extending from said third wall.

4. A curtain system according to claim 1, further comprising:

said third wall is configured adjacent said second pocket to define said second pocket together with said clear wall.

5. A curtain system according to claim 1, for further use with a second speaker and further comprising:

a fourth wall integral with and extending away from said sheet and defining a third pocket in conjunction with said sheet, said third pocket adapted to receive the second speaker therein.

6. A curtain system according to claim 5, wherein:

said channel couples said first pocket and said third pocket.

7. A curtain system according to claim 5, further comprising:

said second speaker located inside said third pocket; and at least one wire coupling said first and second speakers and running through said channel to said second pocket.

8. A curtain system according to claim 7, further comprising:

a battery pack coupled to at least one of said first speaker and said second speaker.

9. A curtain system according to claim 7, further comprising:

said entertainment system located inside said second pocket.

10. A curtain system according to claim 7, wherein:

said closure system closes a top of said first pocket and closes a top of said second pocket.

11. A curtain system according to claim 7, wherein:

said closure system comprises a tongue and a groove, with one of said tongue and groove extending from said sheet, and the other of said tongue and groove extending from said third wall.

12. A curtain system according to claim 7, further comprising:

said third wall is configured adjacent said second pocket to define said second pocket together with said clear wall.

13. A curtain system according to claim 7, wherein:

said channel couples said first pocket and said third pocket.

14. A method, comprising:

a) obtaining a curtain for use with at least a first speaker and an entertainment system connected by at least one wire, said curtain comprising (i) a sheet of generally rectangular material having an upper edge, a lower edge, and two side edges;

(ii) a first wall integral with and extending away from said sheet and defining a first pocket in conjunction with said sheet, said first pocket adapted to receive the first speaker therein;

(iii) a clear waterproof second wall sealed to said sheet and forming a wall of a second pocket adapted to receive the entertainment system therein, said clear wall adapted to permit finger-touch control of the entertainment system through said clear second wall;

(iv) a closure system including a third wall integral with said sheet, said closure system providing a channel between said first wall and said third wall where said channel couples said first pocket with said second pocket, said channel adapted to receive the at least one wire;

b) hanging the curtain on a rod;

c) inserting the entertainment system in the second pocket; and d) coupling the wire to the entertainment system.

15. A method according to claim 14, further comprising: using said entertainment system through said clear wall.

16. A method according to claim 15, further comprising: sealing said entertainment system in the second pocket by sealing the channel.

17. A method according to claim 14, wherein:

said curtain further includes said first speaker located inside said first pocket and said at least one wire running through said channel and coupling said first speaker to said entertainment system.

18. A method according to claim 14, further comprising:

e) inserting said first speaker inside said first pocket;

f) running said wire through said channel;

g) coupling said first speaker to said entertainment system with said wire; and h) sealing the channel.

19. A curtain system according to claim 1, further comprising:

a tab adjacent said clear waterproof second wall.

* * * * *